US005373799A

United States Patent [19]

Green

[11] Patent Number: 5,373,799

[45] Date of Patent: Dec. 20, 1994

[54] COLLAPSIBLE SAILING RESCUE WATERCRAFT

[76] Inventor: Marvin P. Green, 79 Burningtree Dr., Groten, Conn. 06340

[21] Appl. No.: 151,905

[22] Filed: Nov. 15, 1993

[51] Int. Cl.[5] ..... B63B 1/00

[52] U.S. Cl. ..... 114/61; 114/39.1

[58] Field of Search ..... 114/39.1, 61, 123, 352–354, 114/283, 284

[56] References Cited

U.S. PATENT DOCUMENTS

| | | | |
|---|---|---|---|
| 697,539 | 4/1902 | Pruden | 114/352 |
| 1,132,924 | 3/1915 | Gepack | 114/123 |
| 2,427,772 | 9/1947 | Farish | 114/352 |
| 2,495,190 | 1/1950 | Stewart | 9/1 |
| 3,139,058 | 6/1964 | Robinson | 114/352 |
| 3,450,084 | 6/1969 | Gerbracht | 114/665 |
| 3,960,102 | 6/1976 | Davy | 114/123 |
| 4,353,321 | 10/1982 | Liu | 114/283 |
| 4,465,008 | 8/1984 | Liggett | 114/39 |
| 4,898,113 | 2/1990 | Tapley et al. | 114/283 |

*Primary Examiner*—Edwin L. Swinehart
*Attorney, Agent, or Firm*—Rhodes & Ascolillo

[57] ABSTRACT

In a preferred embodiment, a watercraft which is carried by a main watercraft, including: a longitudinally extending horizontal central hull portion; port and starboard longitudinally extending horizontal pontoons being movably attached to the central hull portion: the port and starboard pontoons being extendable from a collapsed position nested against sides of the central hull portion to an extended position spaced apart from the central hull portion and parallel to the central hull portion; and the central hull portion and the port and starboard pontoons in the extended position comprising a trimaran.

3 Claims, 6 Drawing Sheets

COLLAPSIBLE SAILING RESCUE WATERCRAFT

BACKGROUND OF THE INVENTION

1. Field of the Invention

The present invention relates to rescue watercraft generally and, more particularly, but not by way of limitation, to a novel collapsible sailing rescue watercraft which may be carried on a larger watercraft or which may serve as an outrigger or pontoon of a multihull watercraft prior to use as a rescue watercraft.

2. Background Art

Being mindful that one must always remain with one's watercraft as long as possible in emergency situations, the time may come when one must abandon ship. In such a case, one hopefully has an inflatable raft aboard or a dinghy which one may launch and transfer into when it is clear that one's main watercraft is being lost.

There are some disadvantages of conventional life saving craft. The types that inflate after being launched are often uncomfortable and generally lack any significant means for propulsion, leaving the castaway to the vagaries of wind and current to hopefully move to safety. The types of life saving craft that are rigid or are inflated when carried on the main watercraft offer more comfort and usually can accommodate some significant form of propulsion, but the bulk of such life saving craft consumes space and so are impractical on smaller watercraft. There exists a need for a life saving craft that can be carried on a main watercraft in a collapsed state, without consuming a great deal of space, yet is comfortable and can accommodate a significant form of propulsion when deployed.

Stewart U.S. Pat. No. 2,495,190, issued Jan. 17, 1950, describes a folding catamaran which has a central, elevated occupant carrying portion having a flat bottom and four floats which are disposed under the flat bottom in a folded position and which rotate outwardly from the corners of the bottom to an extended position.

Gerbracht U.S. Pat. No. 3,450,084, issued Jun. 17, 1969, describes a boat having a central hull portion and outriggers disposed on either side thereof and removably attached thereto by means of struts.

Liu U.S. Pat. No. 4,353,321, issued Oct. 12, 1982, describes a waterbike which includes a middle pontoon having a motor and a propeller and a seat for the operator, a rotatable front pontoon forward of the middle pontoon used for steering, and a pair of side-by-side stabilizing pontoons abaft the middle pontoon which are rotatable outwardly from the centerline of the waterbike to provide stability therefor.

Liggett U.S. Pat. No. 4,465,008, issued Aug. 14, 1984, describes a multihull sailcraft having a central hull portion and starboard and port pontoons cantilevered to the central hull portion for pivoting between an extended, sailing position and a retracted, transport position.

Tapley U.S. Pat. No. 4,898,113, issued Feb. 6, 1990, describes a detachable outrigger assembly for use with a sail-board.

None of the above watercraft overcomes the disadvantages of conventional rescue watercraft noted above.

Accordingly, it is a principal object of the present invention to provide a rescue watercraft which is carried by a main watercraft, the rescue watercraft being comfortable and safe, yet consuming a minimum amount of space when carried aboard the main watercraft.

It is a further object of the invention to provide such a rescue watercraft that can accommodate a significant means of propulsion.

It is an additional object of the invention to provide such a watercraft that can be rapidly deployed.

It is another object of the invention to provide such a rescue watercraft that can be economically constructed.

Other objects of the present invention, as well as particular features, elements, and advantages thereof will be elucidated in, or be apparent from, the following description and the accompanying drawing figures.

SUMMARY OF THE INVENTION

The present invention achieves the above objects, among others, by providing, in a preferred embodiment, a rescue watercraft which is carried by a main watercraft, comprising: a longitudinally extending horizontal central hull portion; port and starboard longitudinally extending horizontal pontoons being movably attached to said central hull portion; said port and starboard pontoons being extendable from a collapsed position nested against sides of said central hull portion to an extended position spaced apart from said central hull portion and parallel thereto; and said central hull portion and said port and starboard pontoons in said extended position comprising a trimaran.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
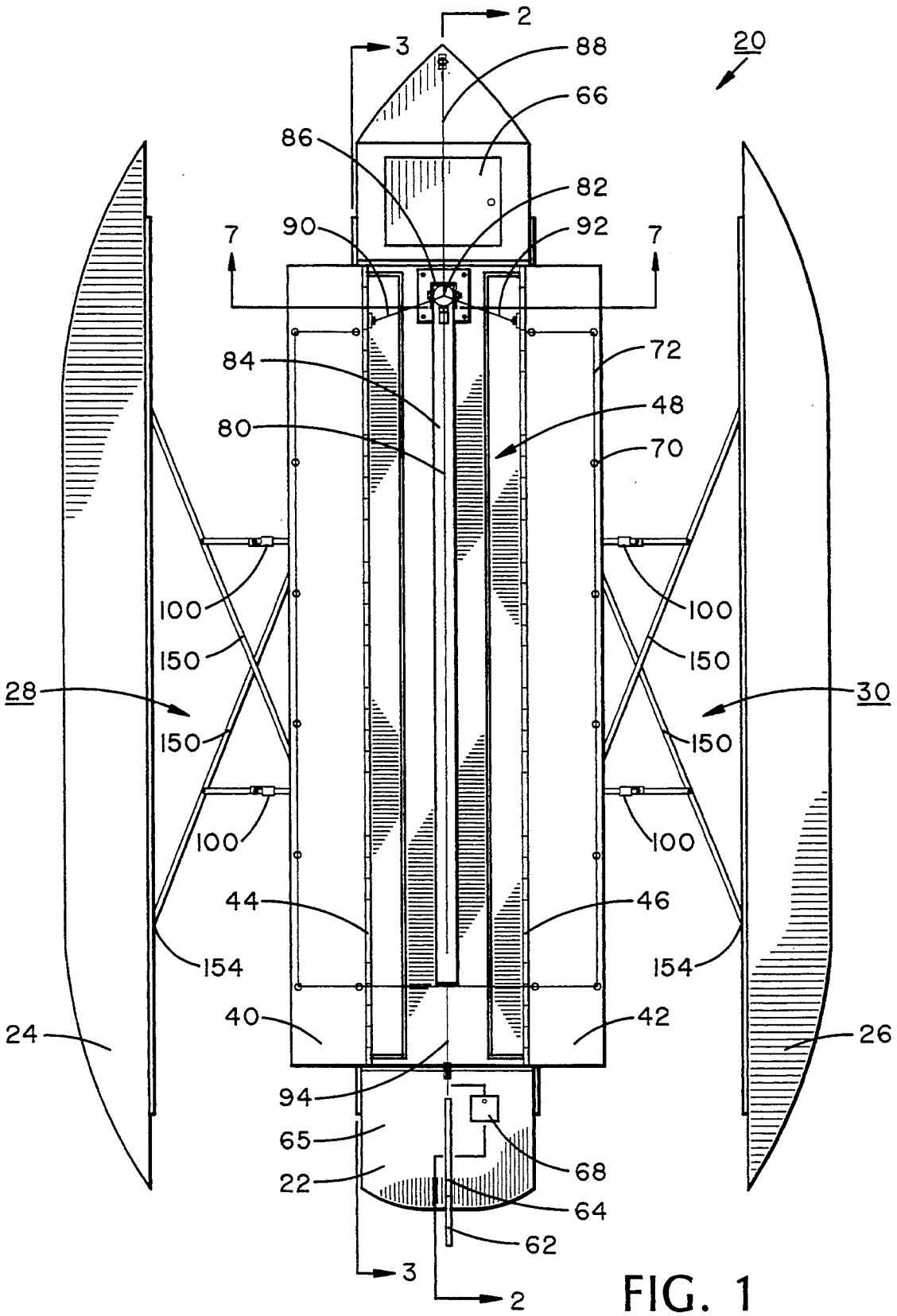
FIG. 1 is a top plan view of a rescue watercraft according to the present invention, rigged and fully deployed.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
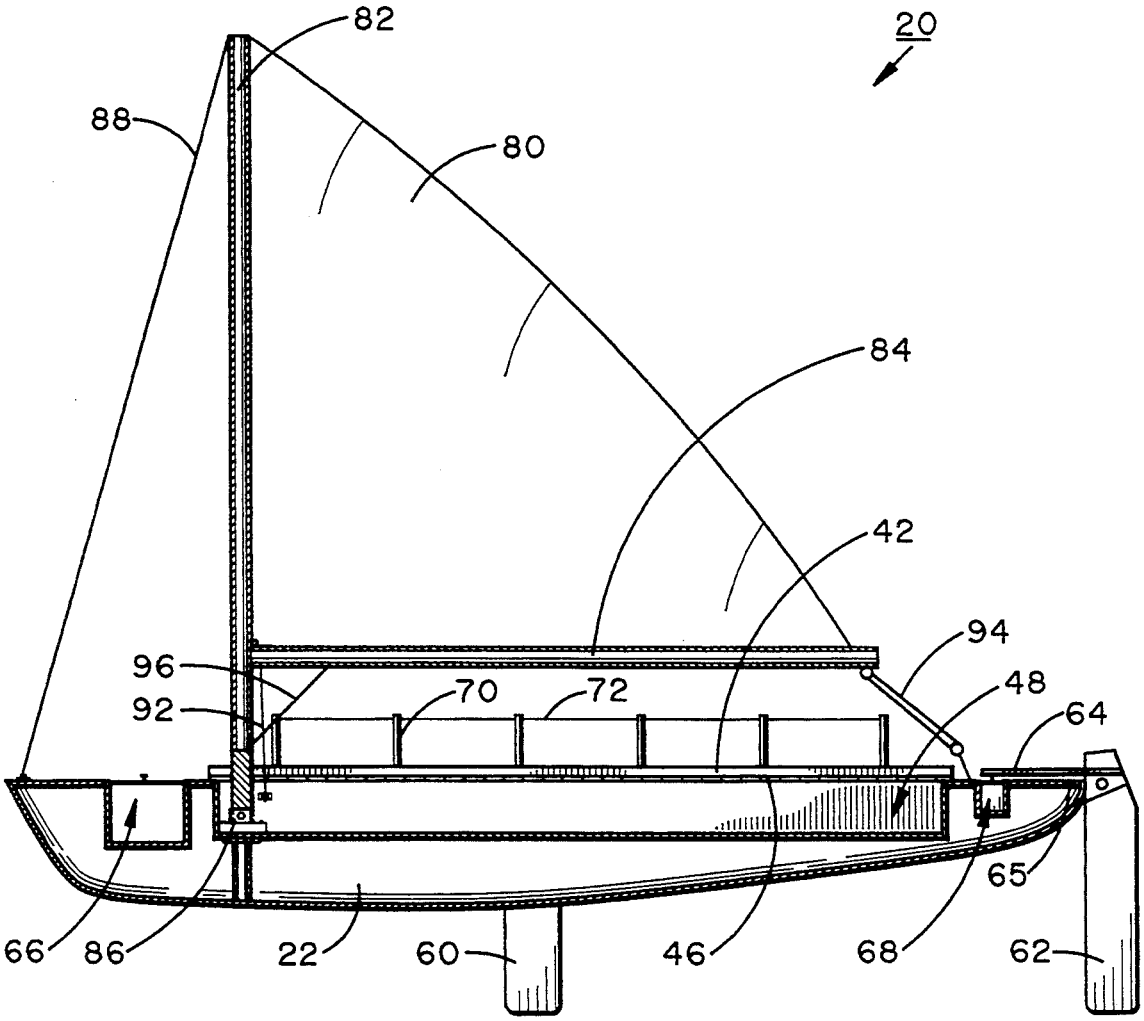
FIG. 2 is a side elevational view, in cross-section, taken along line "2—2" of FIG. 1.
Figure 8:
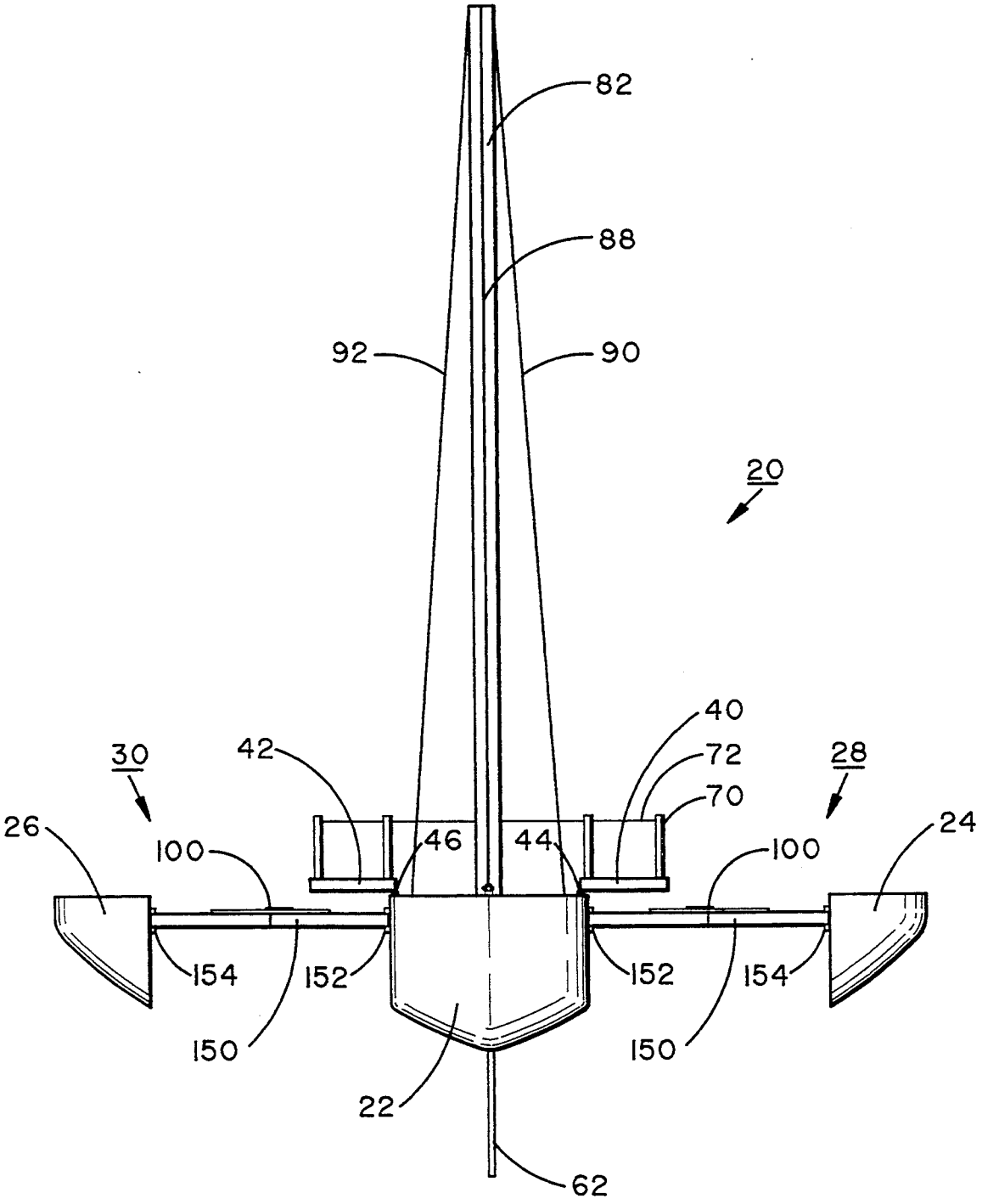
FIG. 8 is a front elevational view of the rescue watercraft of FIG. 1.

Reference first should be made to FIGS. 1, 2, and 8 for an understanding of the construction of the rescue watercraft of the present invention, generally indicated by the reference numeral 20. Watercraft 20 includes a central hull portion 22 with port and starboard pontoons 24 and 26 (FIG. 1), respectively, attached to the central hull portion 22 by means of foldable strut assemblies, generally indicated by the reference numerals 28 and 30, respectively. Hull portion 22 includes port and starboard side decks 40 and 42 (FIG. 1), respectively, attached by means of piano type hinges 44 and 46, respectively, to the upper side edges of a center cockpit 48 extending along the centerline of the hull portion 22. A dagger board 60 depends front the bottom of hull portion 22, a rudder 62 with a tiller 64 is attached to the transom 65 thereof (FIGS. 1, 2, and 3), and forward and aft compartments 66 and 68, respectively, are provided in the hull portion 22 for the stowage therein of auxiliary and safety equipment. Disposed around the outboard perimeters of side decks 40 and 42 are a plurality of lifeline stanchions, as at 70, with a lifeline 72 extending between the upper ends thereof.

Rescue watercraft 20 is a Marconi type of sloop rig, with a mainsail 80 bent to a vertical mast 82 and a horizontal boom 84. Mast 82 is stepped in a tabernacle 86 and is supported by a headstay 88 and port and starboard shrouds, 90 and 92, respectively. A jib (not shown) may be bent to headstay 88. A main sheet 94 extends between the distal end of boom 84 and hull portion 22 and a boom vang 96 extends between a point on the boom near the proximal end thereof and a point on mast 82 near the proximal end thereof.

It can be seen that rescue watercraft 20 is comfortable and can be sailed in a conventional manner to safety.

Figure 5:
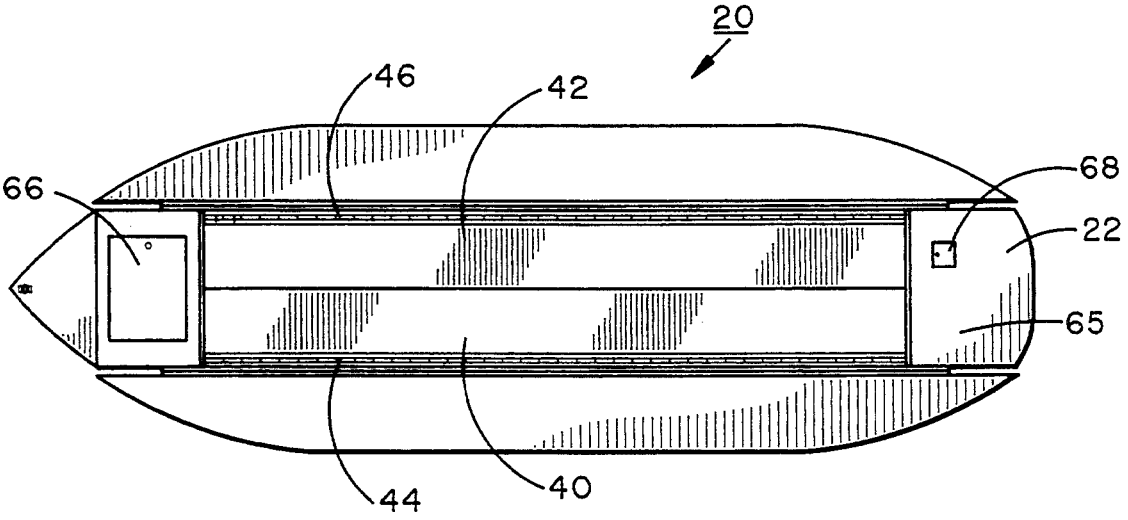
FIG. 5 is a top plan view of the rescue watercraft of FIG. 1 in a fully collapsed position.

FIG. 5 illustrates rescue watercraft 20 in its collapsed state. The rescue watercraft 20 may be stowed on a main watercraft (not shown). In either case, mainsail 80, mast 82, and boom 84 (FIG. 3) may be stowed in cockpit 48 (FIGS. 1 and 2) with hinged side decks 40 and 42 rotated inward so as to provide a sealing cover for the cockpit.

Figure 6:
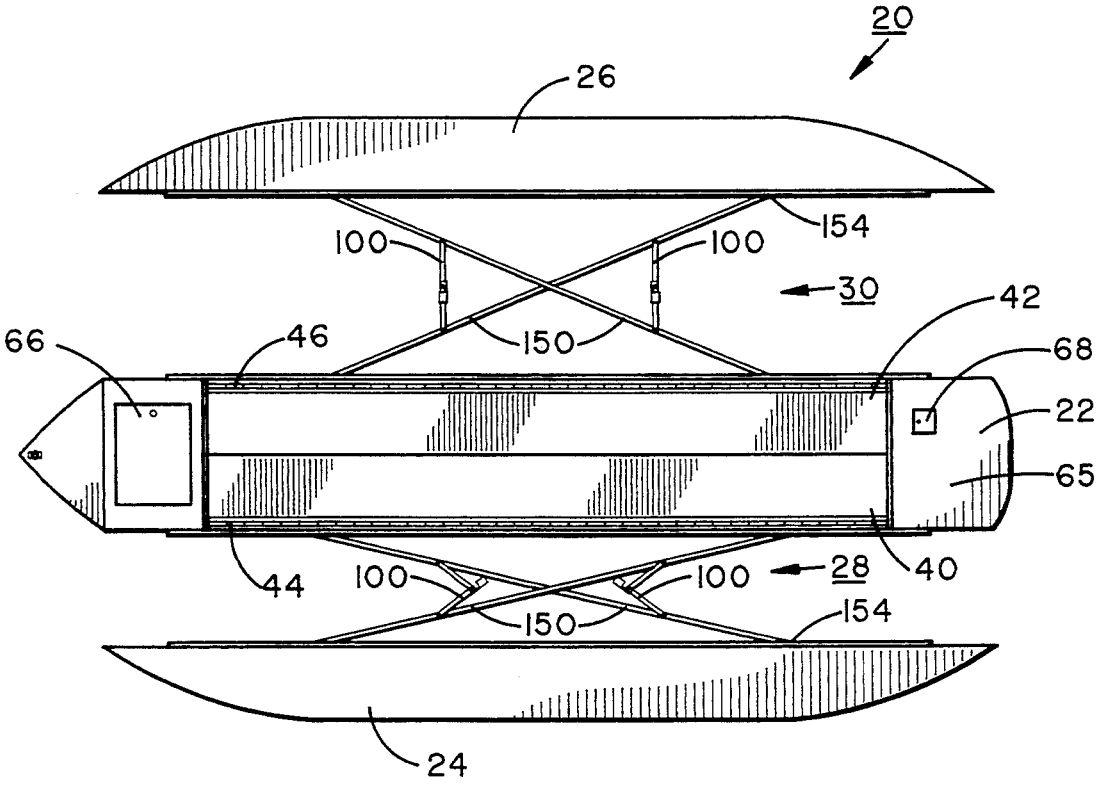
FIG. 6 is a top plan view of the rescue watercraft of FIG. 1 partially deployed.

FIG. 6 illustrates the first step in deploying rescue watercraft 20. Here, starboard pontoon 26 has been fully extended, with intermediate locking scissors struts 100 straightened and locked. Port pontoon 24 is shown as being partially extended.

Figure 3:
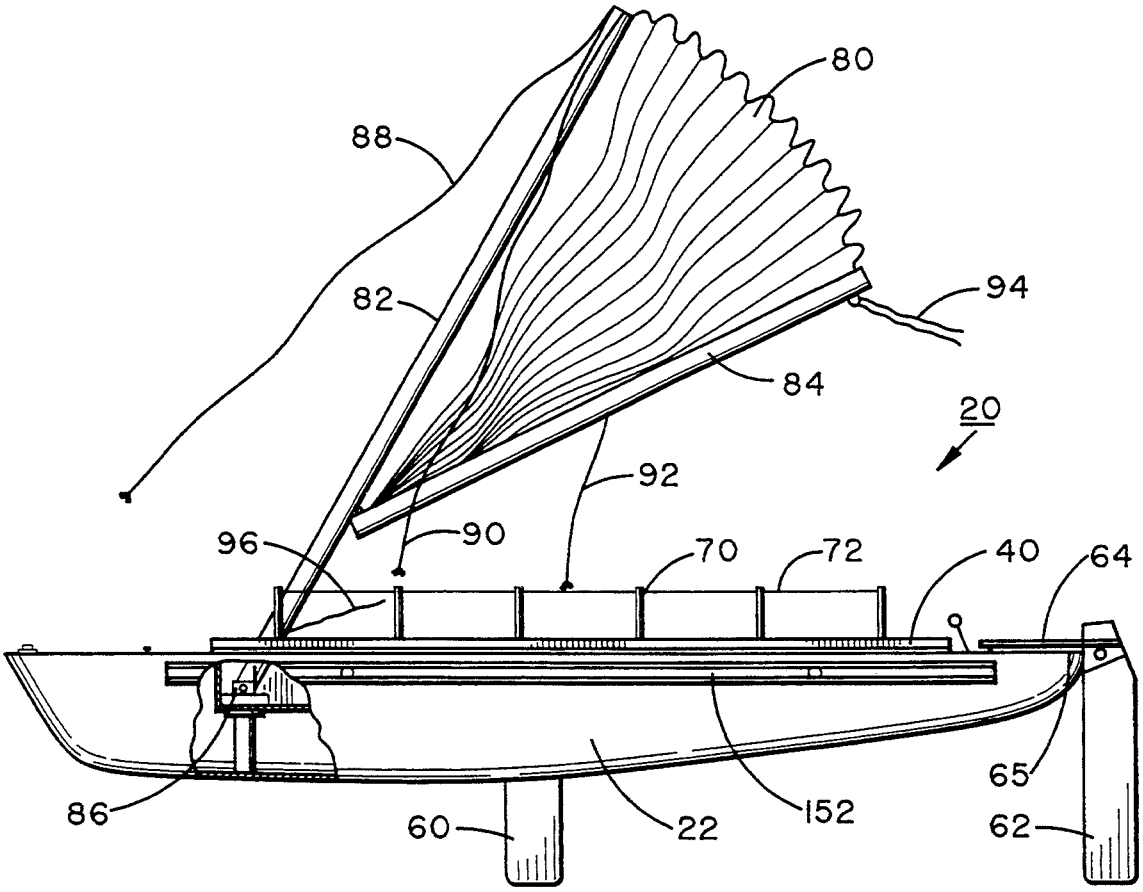
FIG. 3 is a side elevational view, in cross-section, taken along line "3—3" of FIG. 1 illustrating the mast of the watercraft being rotated into position.

As is illustrated on FIG. 3, when pontoons 24 and 26 have both been fully extended and locked in place, side decks 40 and 42 are rotated open, daggerboard 60 and rudder 62 (also stowed in closed cockpit 48) are placed in position to give rescue watercraft 20 some directional stability, and mast 82 is rotated to a vertical position, with boom 84 rotating downwardly to unfold mainsail 80. Headstay 88 and shrouds 90 and 92 are then attached to hull portion 22 and main sheet 94 is placed in position. Rescue watercraft; 20 is now rigged and ready to sail.

Figure 7:
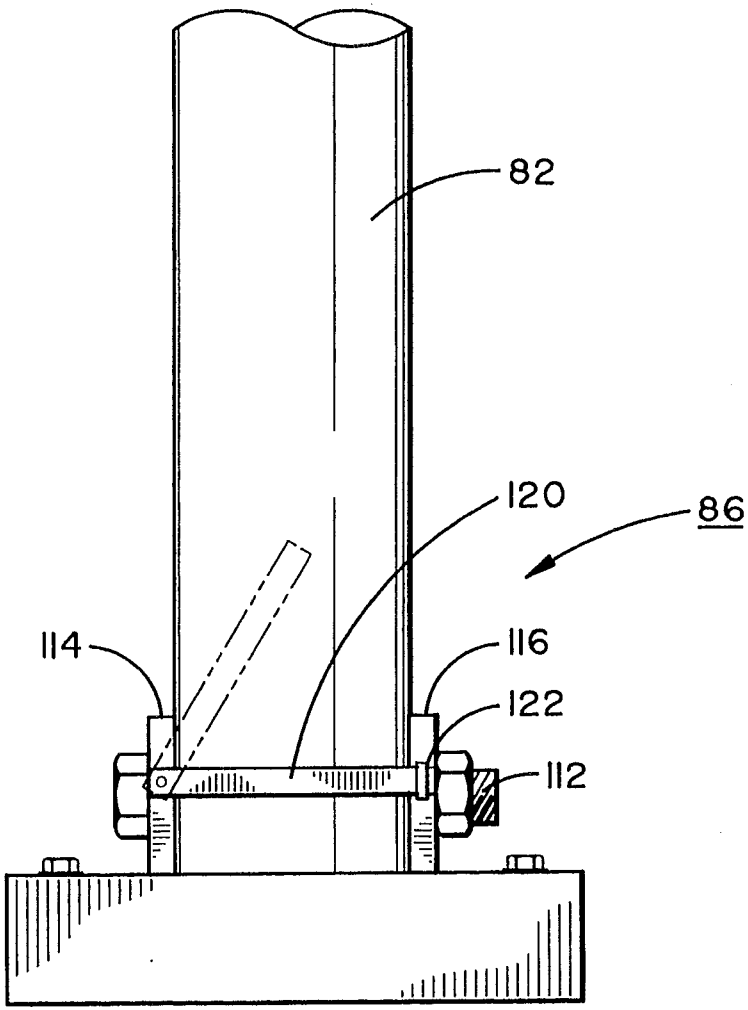
FIG. 7 is a fragmentary rear elevational view taken along line "7—7" of FIG. 1.
Figure 4:
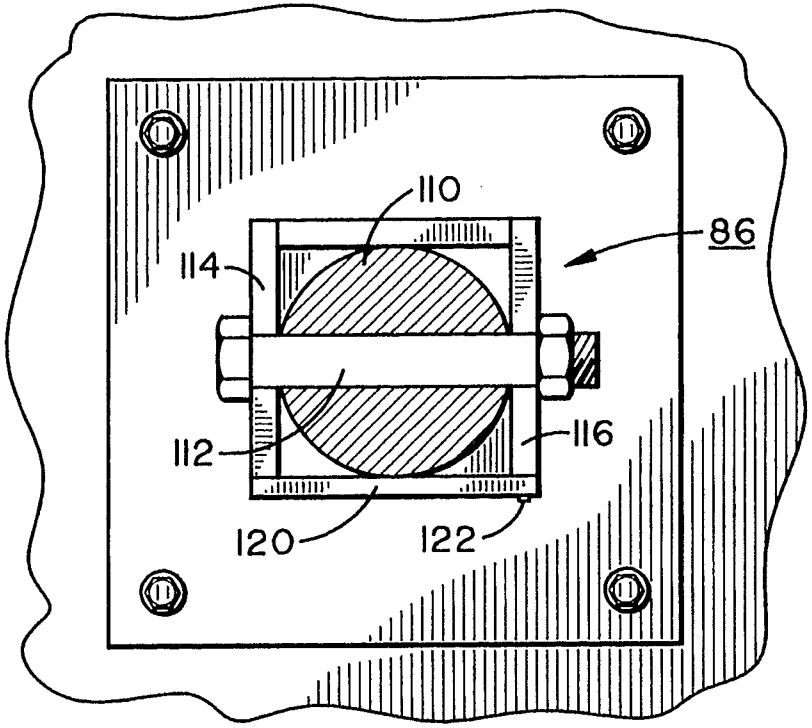
FIG. 4 is a fragmentary top plan view, partially in cross-section, of the mast tabernacle of the rescue watercraft of FIG. 1 with the mast stepped therein.

With reference to FIGS. 4 and 7, a solid proximal end 110 of mast 82 is rotatable about a horizontal bolt 112 attached to and extending between first and second spaced apart vertical flanges 114 and 116, respectively, of tabernacle 86 to permit the mast to be raised from its horizontal stowed position in cockpit 48 (FIG. 5) to its vertical position (FIG. 2). To assist in holding mast 82 in vertical position while the standing rigging is being attached to hull portion 22, a bar 120 (FIG. 7) rotatably attached to the aft edge of flange 114 may be rotated across the aft edge of the mast and dropped into a slot 122 formed on the aft edge of flange 116.

Returning now to foldable strut assemblies 28 and 30 (FIG. 1), each includes two crossed main struts 150 having the proximal ends thereof slidably engaged to hull portion 22 at rails 152 (FIG. 8) and the distal ends thereof rotatably attached to joints 154 which are attached to pontoons 24 and 26. Thus, when pontoons 24 and 26 are moved from their positions shown on FIG. 5 to the positions shown on FIG. 1, the proximal ends of main struts 150 will slide along rails 152 (FIG. 8) while the distal ends of the main struts will rotate around hinges 154 on the pontoons until intermediate locking scissors struts 100 are fully extended. The scissor struts 100 are then locked, securing the pontoons 24 and 26 in an extended position. As seen in FIG. 6, the intermediate locking scissors struts 100 are each rotatably attached between two crossed main struts 150 on each side of the rescue watercraft 20.

Equipment (not shown) which may be stowed in compartments 66 and 68 and cockpit 48 includes a gyro compass, flares, anchors, food, water, fishing gear, life preservers, cots, a propane stove, and a cockpit cover.

Rescue watercraft 20 may be economically constructed of wood, metal, and/or fiberglass materials commonly employed in watercraft construction.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A watercraft comprising:

(a) a longitudinally extending horizontal central hull portion;

(b) port and starboard longitudinally extending horizontal pontoons being movably attached to said central hull portion;

(c) means for extending each of said port and starboard pontoons comprising:

(1) two crossed horizontal main struts extending between said central hull portion and said pontoon:

(2) joints fixedly attached to the inboard side of said pontoon, and the distal ends of said main struts being rotatably attached to said joints: and (3) proximal ends of said main struts being slidably attached to a horizontal slide attached to an outboard side of said central hull portion:

(d) said port and starboard pontoons being extendable from a collapsed position nested against sides of said central hull portion to an extended position spaced apart from said central hull portion and parallel thereto: and (e) said central hull portion, with said port and starboard pontoons in said extended position, comprising a trimaran watercraft.

2. A watercraft comprising:

(a) a longitudinally extending horizontal central hull portion;

(b) port and starboard longitudinally extending horizontal pontoons being movably attached to said central hull portion;

(c) means for extending each of said port and starboard pontoons comprising:

(1) two crossed horizontal main struts extending between said central hull portion and said pontoon;

(2) joints fixedly attached to the inboard side of said pontoon, and the distal ends of said main struts being rotatably attached to said joints;

(3) proximal ends of said main struts being slidably attached to a horizontal slide attached to an outboard side of said central hull portion; and (4) at least one intermediate locking scissors strut being rotatably attached between two of said main struts disposed on said central hull portion;

(d) said port and starboard pontoons being extendable from a collapsed position nested against sides of said central hull portion to an extended position spaced apart from said central hull portion and parallel thereto; and (e) said central hull portion, with said port and starboard pontoons in said extended position, comprising a trimaran watercraft.

3. A watercraft comprising:

(a) a longitudinally extending horizontal central hull portion;

(b) said central hull portion comprising:

(1) a longitudinally extending cockpit defined through an upper surface of said central hull portion;

(2) first and second side decks rotatably attached to and extending along upper opposite side edges of said cockpit; and (3) said first and second side decks being rotatable between a folded position, in which said first and second side decks are rotated over said cockpit to form a cover therefor, and an open position, in which said first and second side decks extend horizontally outward from said side edges of said cockpit;

(c) a mast having a proximal end rotatably attached to a lower portion of said cockpit and rotatable from a first position, in which said mast is disposed in said cockpit, to a second position, in which said mast extends vertically with respect to said central hull portion;

(d) said mast having a boom and a sail bent thereto when said mast is in said first position:

(e) port and starboard longitudinally extending horizontal pontoons being movably attached to said central hull portion;

(f) means for extending each of said port and starboard pontoons comprising:

(1) two crossed horizontal main struts extending between said central hull portion and said pontoon;

(2) joints fixedly attached to the inboard side of said pontoon, and the distal ends of said main struts being rotatably attached to said joints;

(3) proximal ends of said main struts being slidably attached to a horizontal slide attached to an outboard side of said central hull portion; and (4) at least one intermediate locking scissors strut being rotatably attached between two of said main struts disposed on said central hull portion;

(g) said port and starboard pontoons being extendable from a collapsed position nested against sides of said central hull portion to an extended position spaced apart from said central hull portion and parallel thereto: and (h) said central hull portion, with said port and starboard pontoons in said extended position, comprising a trimaran watercraft.

* * * * *